United States Patent [19]

Adams

[11] 4,305,672

[45] Dec. 15, 1981

[54] MIXING DEVICE FOR VISCOUS LIQUIDS

[75] Inventor: James M. Adams, Houston, Tex.

[73] Assignee: Matcote Company, Inc., Houston, Tex.

[21] Appl. No.: 135,883

[22] Filed: Mar. 31, 1980

[51] Int. Cl.[3] ..... B01F 5/06

[52] U.S. Cl. ..... 366/336

[58] Field of Search ..... 366/336, 337, 338, 339, 366/340, 341; 422/49, 224; 239/419, 419.3, 422, 427

[56] References Cited

U.S. PATENT DOCUMENTS

| | | | |
|---|---|---|---|
| 2,740,616 | 4/1956 | Walden | 366/336 |
| 3,032,278 | 5/1962 | Thomas | 366/336 |
| 3,089,683 | 5/1963 | Thomas | 366/340 |
| 4,027,857 | 6/1977 | Cunningham | 366/340 |
| 4,074,363 | 2/1978 | Croft | 366/339 |

*Primary Examiner*—Robert W. Jenkins

*Attorney, Agent, or Firm*—Pravel, Gambrell, Hewitt, Kirk, Kimball & Dodge

[57] ABSTRACT

An improved mixing device for viscous liquids includes an elongated body with an opening extending axially through the entire length of the body. An elongated diffuser is located in the opening with pathways therein for forming a circuitous path for mixing viscous liquid flowing under pressure through the opening. There are stops associated with both ends of the diffuser for holding it in place in the opening when liquid is flowing through the diffuser. At least one of the stops is removable and includes female threads which cooperate with male threads on the outer surface of the body so that when the stop is removed the diffuser can be axially removed from the opening through at least one end thereof, an end of the diffuser being accessible through the other end of the opening and shaped so that an axial force can be applied to remove the diffuser, if necessary.

6 Claims, 3 Drawing Figures

MIXING DEVICE FOR VISCOUS LIQUIDS

BACKGROUND OF THE INVENTION

This invention relates to static mixing devices for mixing viscous liquids and, more particularly, to an improvement which makes such a device significantly easier to disassemble and clean.

Static mixing devices have been used in the past for mixing an epoxy resin with a catalyst or promoter for delivery to a spraying apparatus such as the one shown in U.S. Pat. No. 3,032,278, which is owned by the same corporate entity which owns the subject invention. The apparatus shown in that patent operates to chop particles such as glass fibers from the end of a fiber rope and simultaneously spray the particles and the mixed liquids in such a way that they will merge together. The fibers are thus coated with the epoxy resin which will adhere to a surface and form a protective coating.

An example of a prior art static mixing device over which the subject invention is an improvement is shown and described in U.S. Pat. No. 3,089,683, which is also owned by the same corporate entity which owns the subject invention, the subject matter of which is incorporated by reference herein as though totally set forth. The mixer shown in that patent includes an elongated body with upper and lower body portions. The two viscous liquids to be mixed are introduced under pressure into a chamber located in the lower body portion. An initial mixing means for initially combining the liquids is located in the chamber and is threadedly connected with the upper end of the lower body. The upper body is in turn threadedly connected with the mixer. A diffuser which operates to thoroughly mix the liquids by imparting a turbulent flow pattern to them is inserted through the upper end of a longitudinal bore in the upper body portion and abuts against a shoulder located in the lower portion of the bore. The diffuser is formed integral with an upper enlarged portion which is threadedly connected with the upper end of the upper body portion. A coupling is mounted in the bore of the enlarged portion so that a hose can be connected for transmitting the mixed liquids to a spraying apparatus such as the one mentioned above.

Although the mixer just described works well for its intended purpose and effectively mixes viscous liquids, problems have been encountered when the mixing device is allowed to sit for awhile before it is cleaned. The liquid inside will harden which makes disassembly extremely difficult. This is because the only way the diffuser can be removed from the longitudinal bore is by unscrewing the enlarged portion of the diffuser from the upper body, and when the liquid inside hardens considerable force is normally required to loosen the diffuser so that it can be unscrewed. The diffuser has been known to become twisted and distorted when portions have stubbornly refused to loosen. Even attempts to unscrew the lower body portion from the upper body portion and heat the hardened resin with a torch to loosen the diffuser have not always been successful with the diffuser itself being burned on occasion. Difficulties have also been encountered in cleaning the initial mixing means since an opening does not extend through its entire length.

Even an arrangement such as the one shown in U.S. Pat. No. 4,027,857 is not satisfactory where a diffuser is formed as a removable element in a cylindrical housing. This is because the upstream end of the diffuser is not shaped in a way where force can be applied if the diffuser is stuck in the housing. Further, the downstream end of the element is held in place by a nozzle which is connected to the housing through female threads in the downstream end of the housing. This type of connection has been found to cause disassembly problems when the liquid is allowed to harden since the threads are exposed directly to the liquid which can find its way between the threads and adhere the adjacent surfaces together.

SUMMARY OF THE INVENTION

The problems of removing the diffuser discussed above have been solved in accordance with the invention by redesigning the upper body portion and diffuser so that the diffuser can be isolated in the longitudinal bore of the upper body and removed with the help of a press if the liquid should harden.

Instead of forming the diffuser as an integral part of a component which is threadedly connected with the main body of the mixer, the diffuser is formed as an independent element and inserted into the longitudinal bore from the lower end. Another body portion with female threads is connected to the main body through cooperating male threads on the outer surface of the main body. The upper end of the diffuser engages a shoulder formed in the bore and the lower end is coextensive with the lower end of the upper body portion so that when the mixer is assembled the diffuser is held firmly in place by the other body portion.

Disassembly is an easy task even when the liquid inside the diffuser is allowed to harden. The upper body portion is unscrewed from the adjacent other body portion. This can easily be done since there are few places where the hardened liquid can adhere the two sections together and the male threads on the upper body will prevent liquid from getting between the threads and adhering the body portions together. If the diffuser cannot be manually removed a hose coupling element can be removed from the upper end of the bore so that an axial force can be applied to the diffuser to push it out of the bore.

Thus, by forming the diffuser as an independent element instead of as an integral part of an element which is threadedly connected with the main body, the need to rotate the diffuser when the other element is unscrewed is eliminated. This enables the diffuser to be isolated in the bore so that it can be easily removed.

Further, in order to facilitate cleaning the internal portion of the initial mixing means a clean-out plug has been provided at its lower end, which can easily be removed.

These seemingly simple design changes provide significant advantages by facilitating disassembly and cleaning of the static mixing device, substantially reducing the amount of time involved in those operations, and lowering the risk of damaging the equipment.

BRIEF DESCRIPTION OF THE DRAWINGS

A better understanding of the invention can be obtained when a detailed description of a preferred embodiment set forth below is considered in conjunction with the accompanying drawings, in which.

DETAILED DESCRIPTION OF A PREFERRED EMBODIMENT

Figure 1:
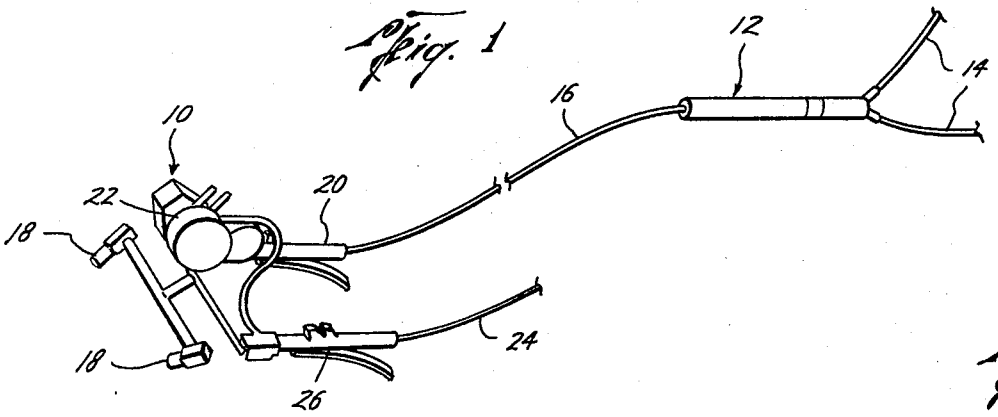
FIG. 1 is a schematic view of the static mixing device and spray apparatus.
Figure 3:
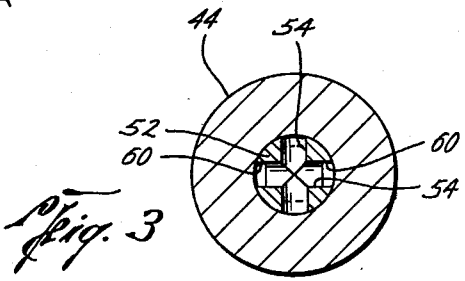
FIG. 3 is a sectional view of the mixing device looking along a section line in the direction of arrows 3—3 as shown in FIG. 2.

A spraying apparatus 10 and static mixing device 12 are shown in FIG. 1. The mixing device 12 operates to mix epoxy resin with a catalyst or promoter which is then supplied to the spraying apparatus where the resin is sprayed onto a surface along with particles of, for example, fiberglass in a manner described in detail below for forming a protective coating.

The epoxy resin and catalyst or promoter are introduced into the mixer 12 under pressure through conduits 14 and are thoroughly mixed as they flow through the mixer 12 in a manner which is described below. The mixed liquid then flows through a conduit 16 to spray nozzles 18 through a valve (not shown) controlled by a pistol grip handle 20 of a type known in the art. The liquid is discharged from the nozzles 18 in a pattern where the two sprays converge with each other and with particles of a fiberglass material (not shown) which are discharged from the front end of a chopper 22.

The chopper 22 operates to shred particles from an elongated rope (not shown) in a manner known in the art. The chopper 22 is operated by compressed air which is introduced through a conduit 24 to a valve (not shown) controlled by a second pistol handle grip 26. A chopper found to be effective is one called a Binks Renegade Chopper manufactured by Binks Manufacturing Company, 9201 West Belmont Avenue, Franklin Park, Ill. 60131. It was found that this particular model rotated too fast for the purposes of the subject spraying apparatus. Rotation was slowed down by regulating an external exhaust valve and tapping an opening into the internal air chamber and incorporating an adjustable set screw for providing an internal exhaust valve.

Operation of the chopper 22 will not be described in detail since it is a standard commercial item. Generally, a rope of glass fibers (not shown) is introduced into one side of the chopper and moves between a pressure roller and a cutting wheel which is rotated by the compressed air regulated by the pistol grip handle 26. The cutting wheel operates to shred the fibers and propel them out of an opening located in the front of the chopper 22 (not shown) in such a way that the fibers will merge with the epoxy resin being sprayed from the nozzles 18 in a manner similar to that described in U.S. Pat. No. 3,032,278 mentioned above. The epoxy resin coats the fibers and causes them to adhere to a surface being sprayed to form a protective coating.

As is apparent, an operator can hold the spraying apparatus by the pistol handles 20, 26, and effectively regulate the amount of epoxy resin and fiberglass particles discharged from the apparatus for forming an optimum coating.

Figure 2:
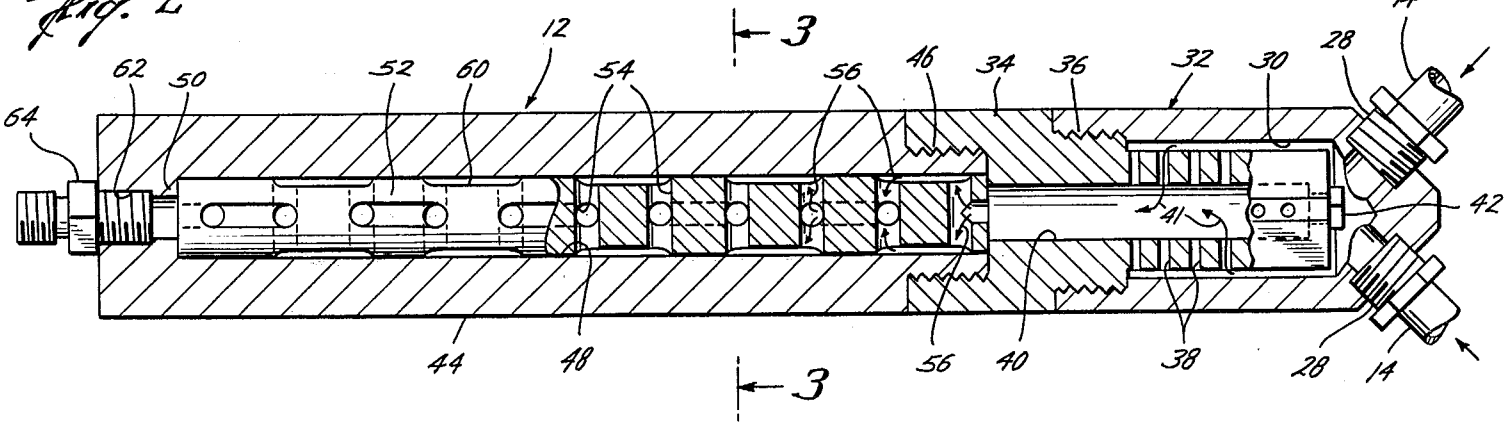
FIG. 2 is a sectional view of the improved static mixing device.

The mixer 12 operates to mix the viscous liquids which form the adhesive thoroughly so that the liquid which emerges from the spray nozzles 18 has a consistent composition. Referring to FIG. 2, viscous liquids to be mixed are introduced into a chamber 30 located in a lower body portion 32 of the elongated mixer 12 through the hoses 14 which are connected to the mixer 12 through couplings 28. The liquids first flow through a preliminary mixer 34 which is mounted in the chamber 30 and connected to the lower body portion 32 through cooperating threads 36, the lower body portion having female threads at its downstream end and the mixer having cooperating male threads at its upstream end. The mixer 34 is closed at its lower end and includes a plurality of passages 38 which extend transversely from its outer surface in the chamber 30 through which the liquids must pass in order to flow into the opening 40 as indicated by arrows 41. The mixer 34 includes a clean-out plug 42 at its lower end which can be removed to facilitate cleaning of the mixer 34.

The fluid flows from the opening 40 into a longitudinal opening 48 formed in an elongated upper body portion 44 which is connected to the preliminary mixer 34 through cooperating threads 46, the mixer 34 having female threads at its downstream end and the upper body portion 44 having male threads at its upstream end with a ledge between the longitudinal opening and the threads. This arrangement makes it difficult for liquid to get between the threads for adhering the mixer to the upper body portion and make disassembly difficult if the liquid should harden. The opening 48 has a shoulder 50 formed at its upper end for engaging the upper end of a diffuser 52 which is inserted into the opening 48 through the lower end of the upper body portion 44.

The length of the diffuser 52 is designed so that the upper end of the diffuser 52 will engage the shoulder 50 and the lower end of the diffuser 52 will engage the preliminary mixer 34 when the upper body portion and mixer 34 are connected as shown in FIG. 2. In this way, the diffuser 52 is held firmly in place while the liquids are moving through it in the following manner. The diffuser 52 is formed with a series of intersecting, perpendicular, transverse openings 54. The adjacent openings 54 are alternately connected together through slots 60 formed in the outer surface of the diffuser 52 for providing a circuitous path through which the liquids must travel, as shown by arrows 56. With this design the liquids will flow from the opening 40, through the lowermost transverse opening 54 and into the connecting slots 60. The liquids then flow into the next succeeding opening 54 which is connected to the slots 60, through the perpendicular intersecting opening 54 and into the next slots 60 which are oriented 90° around the outer surface of the diffuser from the first slots 60. After the liquids follow this path along the entire length of the diffuser 52 they are thoroughly mixed and flow through the outlet opening 62 into the hose 16 which is connected to the upper body portion through a coupling 64.

In order to disassemble the mixing device 12, the upper and lower body portions 44 and 32 are unscrewed from the preliminary mixer 34. The diffuser has a bearing surface at its downstream end so that if the diffuser 52 cannot manually be removed from the upper body portion 44 the coupling 64 can be removed from the outlet opening 62 and an axial force exerted against the upper end of the diffuser 52 by using, for example, a hydraulic press in order to push the diffuser out of the bore 48. This represents a significant improvement over prior art static mixing devices where it was not possible to apply such longitudinal force to the diffuser in order to remove it and, in particular, over the device shown in U.S. Pat. No. 4,027,857 where no such bearing surface is provided.

After all of the parts are disconnected, the elements can be cleaned. Removal of the clean-out plug 42 from the lower end of the preliminary mixer 34 enables the longitudinal opening of that portion 40 easily to be cleaned, another feature which was not incorporated in the static mixer in the prior art.

Thus, there is provided in accordance with the invention a static mixing device which is designed to be easily disassembled and cleaned. Instead of connecting the diffuser portion of the device to an element which must be unscrewed from the main body, the diffuser is formed as a separate element and can be removed simply by applying an axial force. Of the respective surfaces of the elements which are threadedly connected, the surfaces have male-female thread arrangements which make it difficult for dried liquid to adhere adjacent surfaces together. Further, access to the inner bore of the preliminary mixer from both ends allows for easier and more thorough cleaning.

The foregoing disclosure and description of the invention are illustrative and explanatory thereof, and various changes in the size, shape and materials as well as in the details of the illustrated construction may be made without departing from the spirit of the invention.

I claim:

1. An improved static mixing device for viscous liquids, comprising:

(a) an elongated body with an opening extending axially through the entire length of the body, (b) an elongated diffuser in the opening with pathways therein for forming a circuitous path for mixing viscous liquid flowing under pressure through the opening, (c) stop means associated with both ends of the diffuser for holding the diffuser in place in the opening when liquid is flowing through the diffuser, (d) the stop means at least at one end of the body including a stop element with female threads which cooperate with male threads on the outer surface of the body for engaging the diffuser so that when the stop element is removed the diffuser can be axially removed from the opening through at least one end thereof, and (e) an end of the diffuser being accessible through the other end of the opening and including a bearing surface so that an axial force can be applied, if necessary, to said end to remove the diffuser from the opening.

2. The improvement of claim 1, and further including a second body, a preliminary mixer in the second body which is threadedly connected to the downstream end of the second body, the elongated body being connected to the preliminary mixer, the stop means including the downstream end of the preliminary mixer engaging the upstream end of the diffuser.

3. The improvement of claim 2, wherein the preliminary mixer includes an axial opening, the downstream end of which communicates with the diffuser, the upstream end of the mixer being closed and including a removable clean-out plug to facilitate cleaning, the liquid entering the mixer through a plurality of transverse openings between the outer surface and the axial opening.

4. The improvement of claim 1, wherein the stop means includes a shoulder formed in the opening for engaging an end of the diffuser.

5. An improved mixer device for viscous liquids, comprising:

(a) an elongated body including first and second body portions, (b) an axial opening extending through the entire length of the second body portion, (c) a diffuser in the axial opening, the diffuser including a plurality of intersecting passageways for forming a circuitous path for liquid flowing through the diffuser, (d) a shoulder formed near the downstream end of the opening for engaging the downstream end of the diffuser and holding it in place, (e) a chamber in the first body portion, (f) outlet means in the first body portion for admitting liquids to be mixed into the chamber, (g) a preliminary mixer in the chamber for mixing the liquids, the mixer having female threads on its downstream end being threadedly connected with the male threads on the outer surface of the upstream end of the first body portion, and (h) the second body portion having female threads on its downstream end being threadedly connected with male threads on the outer surface of the upstream end of the mixer, the downstream end of the mixer engaging the upstream end of the diffuser for holding the latter in place to permit the liquids to flow from the mixer into the diffuser, the downstream end of the diffuser being accessible through the downstream end of the axial opening and having a bearing surface so that after the second body portion and mixer are disconnected an axial force can be applied to the downstream end of the diffuser, if necessary, for removing the diffuser from the axial opening.

6. The improvement of claim 5, wherein the preliminary mixer includes an axial opening closed at the upstream end and open at the downstream end, an annular space between the inner surface of the first body portion and the outer surface of the mixer, a plurality of transverse openings in the mixer for connecting the annular space and axial opening, a removeable clean-out plug in the upstream end of the mixer.

* * * * *